United States Patent [19]

Cockfield et al.

[11] Patent Number: 4,557,457

[45] Date of Patent: Dec. 10, 1985

[54] ATTACHMENT ASSEMBLY

[75] Inventors: William Cockfield, Charlevoix; Nancy Martin; Barbara Murray, both of Gaylord, all of Mich.

[73] Assignee: Frame-Lok, Inc., Gaylord, Mich.

[21] Appl. No.: 577,224

[22] Filed: Feb. 6, 1984

[51] Int. Cl.[4] ..... F16M 13/00

[52] U.S. Cl. ..... 248/544; 40/152.1; 248/220.1; 248/222.4; 248/489

[58] Field of Search ..... 248/544, 220.1, 220.2, 248/222.2, 222.3, 222.4, 223.1, 223.2, 489; 40/152.1

[56] References Cited

U.S. PATENT DOCUMENTS

| | | | |
|---|---|---|---|
| 2,647,294 | 8/1953 | Davis | 24/223 |
| 2,839,668 | 6/1958 | Mills | 248/222.4 |
| 2,928,199 | 3/1960 | Novak | 40/152.1 |
| 3,211,409 | 10/1965 | Zimmermann | 248/203 |
| 3,880,396 | 4/1975 | Freiberger et al. | 248/222.2 |
| 3,952,436 | 4/1976 | Kuhnke | 40/152.1 |
| 4,074,888 | 2/1978 | Garner | 248/475 R |
| 4,311,295 | 1/1982 | Jamar | 248/222.2 |
| 4,385,744 | 5/1983 | Sherman et al. | 248/551 |

*Primary Examiner*—Ramon S. Britts
*Assistant Examiner*—Ramon O. Ramirez
*Attorney, Agent, or Firm*—Gerald E. McGlynn, Jr.

[57] ABSTRACT

An attachment assembly for lockably but releasably securing a picture frame or the like to a wall surface. The assembly includes a plurality of bracket plates each having a keyhole opening for coaction with a respective headed fastener element secured to the wall surface, and a locking plate mounted for pivotal movement on one of the bracket plates between an unlocked position in which a mask opening in the locking plate unmasks the head portion of the keyhole opening, to allow passage of the head of the wall fastener element, and a locked position in which the mask opening unmasks the slot portion of the keyhole opening. The mask opening includes a edge surface that extends obliquely across the entrance to the keyhole opening slot portion in the unlocked position of the locking plate and coacts with the shank portion of the wall fastener to rotate the locking plate to its locked position as the shank portion advances into the slot portion of the keyhole opening. The mask opening also includes another edge surface that moves in behind the advancing shank portion and extends perpendicularly across the entrance to the keyhole opening head portion to preclude reverse rotation of the locking plate in response to engagement by the shank portion.

23 Claims, 8 Drawing Figures

ATTACHMENT ASSEMBLY

BACKGROUND OF THE INVENTION

This invention relates to attachment assemblies for lockably but releasably securing one object to another. More particularily, this invention relates to an attachment assembly for lockably but releasably securing a picture frame or the like to a wall surface.

Various devices have been proposed for locking a framed object to a wall in a manner to discourage theft of the framed object. These devices, in general, have been effective in preventing theft of the framed object. However, they have not enjoyed wide spread use because of their complexity. Specifically, their design has been so complex as to generate an unrealistically high initial manufacturing cost and/or their design complexity has dictated a cumbersome installment procedure.

BRIEF SUMMARY OF THE INVENTION

It is accordingly an object of the present invention to provide an attachment assembly for picture frames or the like which is extremely simple in design and yet effective to discourage theft.

A more specific object is to provide an effective anti-theft attachment assembly for picture frames or the like which is extremely inexpensive to manufacture and extremely easy to install.

The invention attachment assembly is designed to lockably but releasably secure a first object to a second object in cooperation with a headed fastener member secured to a surface of the first object. The attachment assembly includes a bracket plate adapted to be secured to a surface of the second object and a locking plate maskingly overlying a keyhole opening in the bracket plate. The locking plate has an unlocked position in which it unmasks the head portion of the keyhole opening in the bracket plate to allow passage of the head of the fastener member, and is moved to a locking position, in which it unmasks the slot portion of the keyhole opening and blocks communication between the slot and head portions of the keyhole opening, in response to movement of the shank portion of the fastener member into the slot portion of the keyhole opening.

According to a further feature of the invention, the locking plate is mounted for pivotal movement on the bracket plate about an axis that lies on the longitudinal center line of the slot portion of the keyhole opening in the bracket plate, and the locking plate has a blocking edge surface which, in the locked position of the locking plate, extends across the entrance to the head portion at right angles to the longitudinal center line of the slot portion so that any efforts to remove the secured object will generate only forces which pass through the pivotal axis of the locking plate and which are, therefore, ineffective to rotate the locking plate to its unlocked positon.

According to a further feature of the invention, the locking plate further defines an actuator edge surface which extends obliquely across the entrance to the slot portion of the keyhole opening with the locking plate in its unlocked position, and the locking plate is moved to its locked positon in response to engagement of the actuator edge surface by the shank portion of the fastener member as the shank portion moves into the slot portion of the keyhole opening.

According to yet another feature of the invention, the blocking and actuator edge surfaces of the locking plate are defined by an irregular mask opening in the locking plate; the mask opening unmasks the head portion of the keyhole opening in the unlocked position of the locking plate with the actuator edge surface extending obliquely across the entrance to the slot portion; and the mask opening unmasks the slot portion of the keyhole opening in the locked position of the locking plate with the blocking edge surface extending perpendicularily across the entrance to the head portion.

According to a further feature of the invention, the attachment assembly includes a release tool that is sized and configured to be inserted between the confronting surfaces of the attached objects to engage a release tab on the locking plate and rotate the plate to its unlocked positon to allow the head portion of the fastener member to be returned to the head portion of the keyhole opening for separation of the objects.

BRIEF DESCRIPTRION OF THE DRAWING

DETAILED DESCRIPTION OF THE PREFERRED EMBODIMENT

Figure 1:
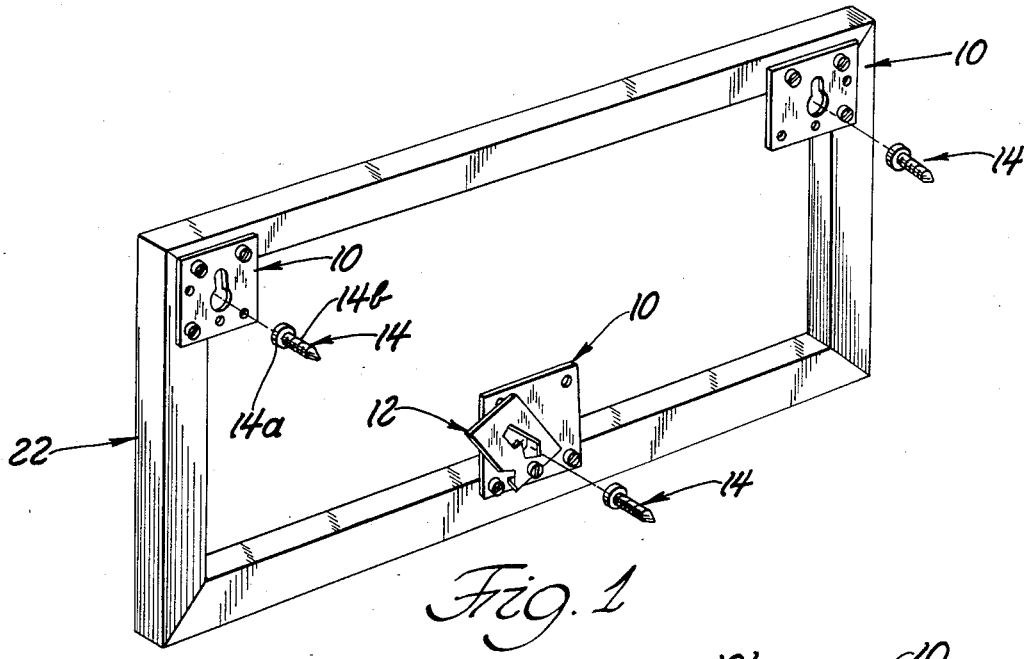
FIG. 1 is a perspective view of the invention attachment assembly as applied to the back of a wooden frame member to be lockably hung on a suitable wall surface.

The invention attachment assembly includes a plurality of rectangular bracket plates 10; at least one somewhat smaller rectangular locking plate 12; wall fastener members 14 having head portions **14*a* and threaded shank portions 14*b*; bracket plate fastener elements 16; template screw assemblies 18; and a release tool 20. The attachment assembly is seen in FIG. 1 in association with a hollow rectangular frame structure 22 formed by left, right, upper and lower frame members. Frame 22** may, for example, comprise a wooden picture frame which is to be hung on a suitable wall surface in a manner to prevent unauthorized removal of the picture from the wall surface.

Figure 2:
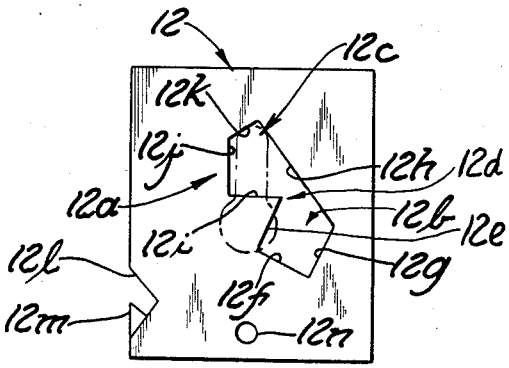
FIG. 2 is a view of a bracket plate forming a part of the invention attachment assembly.
Figure 3:
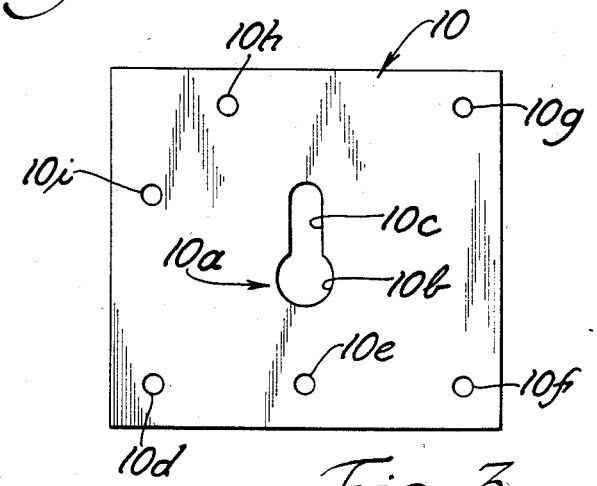
FIG. 3 is a view of a locking plate forming a part of the invention attachment assembly.

Three bracket plates 10 are provided for securement to the back of frame 22. One plate 10 is adapted to be secured to the upper left corner of frame 22, another to the upper right corner, and the third to a central portion of the lower frame member. The three plates 10 are identical. Each plate is formed of sheet steel stock and includes a central keyhole opening **10*a* defined by a central circular head portion 10*b* and a slot portion 10*c* extending vertically and centrally upwardly from head portion 10*b*. Head portion 10*b* has a diameter slightly greater than the diameter of head portion 14*a* of fastener members 14 and slot portion 10*c* has a width slightly greater than the diameter of shank portion 14*b* of fastener members 14 but less than the diameter of head portion 14*a*. A plurality of fastener openings or holes are provided around the periphery of the plate including, as viewed in FIG. 2, three holes 10***d*, 10*e* and 10*f* spaced uniformly along the lower edge of the plate; a hole 10*g* in the upper right corner of the plate; a hole 10*h* along the top edge of the plate adjacent the upper left corner; and a hole 10*i* along the left edge of the plate adjacent the upper left corner. Note that the longitudinal or vertical center line of slot 10*c* passes through central lower hole 10*e*; that attachment holes 10*d*, 10*e*, 10*f* are spaced below the lowest locus of keyhole slot head portion 106; and that attachment holes 10*h* and 10*g* are spaced above the highest locus of slot portion 10*c*.

Locking plate 12 is formed of the same steel sheet stock as bracket plates 10 and is selectively cut out to form a totally surrounded mask opening 12*a*. Opening 12*a* is in the shape of an irregular polygon and, as viewed in FIG. 2, includes a lower portion 12*b*, an upper portion 12*c*, and a neck portion 12*d* interconnecting portions 12*b* and 12*c*. Lower portion 12*b* is generally sized to unmask keyhole opening head portion 10*b* and is defined by right angularly related side edges 12*e* 12*f*, and 12*g* and an oblique actuator side edge 12*h*. Upper portion 12*c* is generally sized to unmask keyhole opening slot portion 10*c* and is defined by a horizontally extending blocking side edge 12*i*, a vertically extending side edge 12*j*, an oblique side edge 12*k*, and oblique actuator side edge 12*h*. Neck portion 12*d* has a width slightly greater than the diameter of shank portion 14*b* of wall fasteners 14. The lower left side edge of locking plate 12 is obliquely notched at 12*l* to define a triangular tab 12*m* and a hole 12*n*, corresponding in size to bracket plate holes 10*d*–10*g*, is provided centrally along the lower edge of the plate. Note that the vertical center line of plate 12 passes through hole 12*n* and centrally and perpendicularily bisects mask opening side edge 12*i*.

The procedure for using the invention attachment assembly to lockably secure a picture frame or the like to a suitable wall surface is as follows:

(1) Frame 22 is placed face down on a suitable support surface and bracket plates 10 are secured to the back of the frame using fastener elements 16. Fasteners 16 may, for example, comprise #6×½ slotted pan head screws. The upper left corner plate is secured by the use of fasteners 16 in holes 10*g*, 10*h*, 10*d* and, if desired, 10*i*. The upper right corner plate 10 is obversely mounted relative to the upper left corner plate and is secured by the use of fasteners 16 in holes 10*g*, 10*h*, 10*d* and, if desired, 10*i*. The peripheral mounting holes and the keyhole openings in the bracket plates are sized and configured so that, as thus mounted to the frame, the keyhole openings in the corner bracket plates are clear of both the top and side frame members and totally within the inner periphery of the frame. The lower plate 10 is centrally secured to the lower frame member by the use of fasteners 16 in holes 10*d* and 10*f*. As thus secured, the heyhole opening in the lower bracket plate is totally above, and clear of, the lower frame member so as to be totally within the inner periphery of the frame.

(2) Template screw assemblies 18 are now installed in each plate 10. Each template assembly includes a screw 24 (for example, a #10 cone point machine screw), a wing nut 26, and a washer 28. Each template screw assembly is installed by passing the head of screw 24 through keyhole opening head portion 10*b*, sliding the shank of the screw upwardly to the top of keyhole opening slot portion 10*c*, passing washer 28 over the shank of the screw, and threading wing nut 26 onto the screw shank to secure the assembly.

(3) The frame is now placed against the wall on which it is to be hung and pressed against the wall to enable the cone points of screws 24 to mark the location for wall fastener members 14. The template assemblies are now removed from brackets 10.

(4) Fastener members 14 are now secured to the wall at the precise locations marked by the template assemblies with the fastener member head portions 14*a* spaced from the wall by ¼ to 3/16 inches. Fastener members 14 may comprise, for example, #10×1½ slotted panhead screws.

(5) Using a pair of pliers, tab portion 12*m* of locking plate 12 is now bent upwardly out of the plane of the locking plate by a distance of approximately ⅛ inch.

Figure 4:
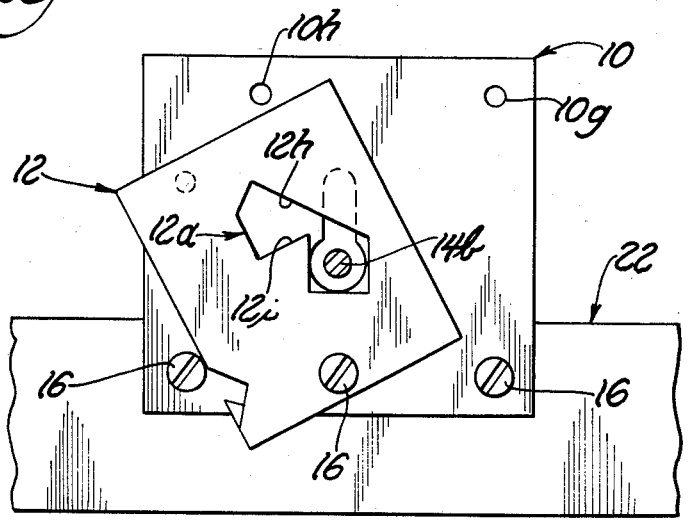
FIGS. 4 and 5 are fragmentary views showing the manner in which the invention attachment assembly functions to lock the frame member to the wall surface.
Figure 5:
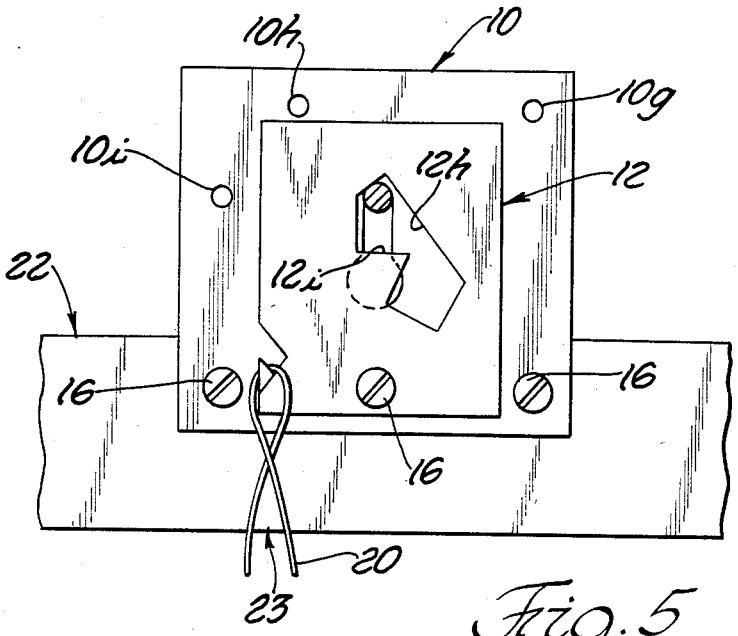
Figure 6:
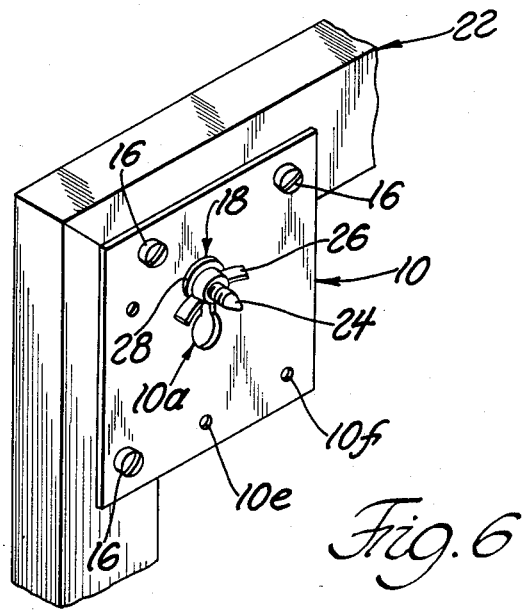
FIG. 6 is a fragmentary perspective view showing a template assembly for use with the invention attachment assembly.

(6) Locking plate 12 is now installed on lower bracket plate 10 by the use of a fastener 16 passing through locking plate mounting hole 12*n* and through the central lower mounting hole 10*e* in bracket plate 10 for threaded engagement with frame 22. The fastener 16 should be tightened to the point where plate 12 will rotate with pressure but will remain firmly in any angular position to which it is moved. With locking plate 12 in its upright position of FIG. 5, a release mark is now made with pencil or scribe on the hidden under surface of the lower frame member at a location 23 directly beneath tab 12*m*. Locking plate 12 is now rotated to its unlocked position, seen in FIG. 4, in which the left side edge of the plate engages the head of the pan head screw in hole 10*d* of bracket plate 10. The left side edge of the locking plate and the screw in hole 10*d* thus coact to define the unlocked position of the locking plate. In this unlocked positon, keyhole opening head portion 10*b* is unmasked by mask opening lower portion 12*b* and keyhole opening slot portion 10*c* is masked with actuator edge surface 12*h* extending obliquely across the entrance to the slot portion.

(7) Frame 22 is now placed against the wall to pass head portions 14*a* of fastener members 14 through keyhole opening head portions 10*b*, whereafter the frame is pulled downwardly to move fastener shank portions 14*b* upwardly into keyhole opening slot portions 10*c*. As the shank portion of the lower fastener 14 moves upwardly into the slot portion of the keyhole opening of the lower bracket plate, it engages oblique actuator edge surface 12*h* of locking plate 12. Since actuator edge surface 12*h* is obliquely disposed with respect to the center line of the slot portion, engagement of edge 12*h* by the fastener shank portion generates a force vector having a moment arm with respect to the pivotal axis of the locking plate. Movement of the fastener shank portion upwardly in the slot portion thus actuates locking plate 12 and rotates it about the axis of central fastener 16. As plate 12 rotates, upper mask opening portion 12*c* rotates into a position in which it unmasks the slot portion and blocking edge surface 12*i* moves in behind the advancing shank portion and assumes a position in which it extends across the entrance to the head portion and blocks communication between the slot and head portions. Locking plate 12 is now in its locked position, seen in FIG. 5, in which the fastener shank portion is trapped in the slot portion and the frame is securely locked to the wall surface.

Any attempted unauthorized removal of the frame from the wall will be thwarted by the trapped state of the shank portion of lower fastener member 14. Specifically, since the longitudinal center line of slot portion 10*c* passes through the pivot axis of locking plate 12 and since blocking edge surface 12*i* is disposed at right angles to that center line, any contact between the trapped shank portion and blocking edge 12*i* generates a force which passes directly through the pivotal axis of the plate and hence has no moment arm. Any such force cannot rotate plate 12 toward its unlocked position.

When it is desired to remove the frame 12 from the wall, a release tool, such as a looped steel wire 20, is pushed upwardly between the frame and the wall surface at the location of release mark 23 to engage release tab 12*m* on locking plate 12. Wire 20 is now pulled downwardly while simultaneously raising frame 22. The downward pull on wire 20 rotates plate 12 to its unlocked position while the simultaneous upward movement of frame 22 allows the trapped shank portion of the lower fastener member to move downwardly in slot portion 10*c* to allow head portion 14*a* to enter keyhole opening head portion 10*b* and allow frame 22 to be removed from the wall.

Figure 7:
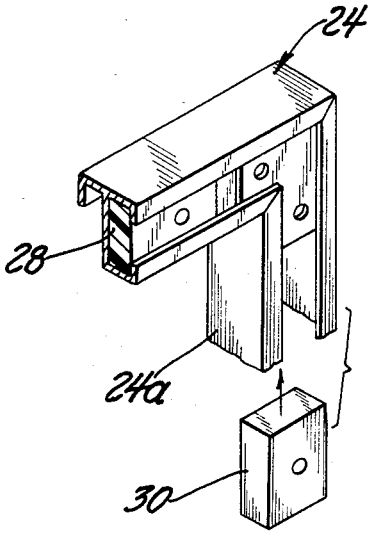
FIGS. 7 and 8 are fragmentary perspective views showing the manner in which the invention attachment assembly is employed with a metallic frame member.
Figure 8:
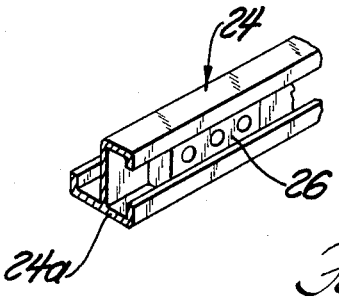

The invention attachment assembly may also be used with a metallic frame. A typical metallic frame 24, as seen fragmentarily in FIGS. 7 and 8, includes a rearwardly opening channel section 24*a*. When the invention attachment assembly is used with a metallic frame, bracket plates 10 are mounted to the frame by the use of plastic block inserts in combination with self-tapping screws. Specifically, a plastic block 26, with three holes, is slidably inserted in the channel section of the lower frame member; plastic blocks 28, with single holes, are slidably inserted in the channel section of the top frame member adjacent the upper left and upper right corners, respectively; and plastic blocks 30, with single holes, are slidably inserted in the channel section of the left and right frame members adjacent the upper left and upper right corners, respectively. Self-tapping screws (for example, 6–32×¼ slotted panhead self-tapping machine screws) are now used to secure bracket plates 10 to frame 24. The remaining steps for securing metallic frame 24 to the appropriate wall surface are identical to the steps previously described with reference to wooden frame 22.

The invention attachment assembly will be seen to provide a simple and effective means of lockably securing a picture frame or the like to a suitable wall surface.

Whereas a preferred embodiment of the invention has been illustrated and described in detail, it will be apparent that various changes may be made in the preferred embodiment without departing from the scope or spirit of the invention. Specifically, although the invention has been disclosed for use with picture frames or the like, it will be apparent that the invention attachment assembly may be used in a wide variety of situations where it is desired to lockably but releasably secure one object to another.

The embodiments of the invention in which an exclusive property or privilege is claimed are defined as follows:

1. An attachment assembly for lockably but releasably securing a first object to a second object in cooperation with a fastener member of the type having a shank portion adapted to securingly engage a surface of the first object and a head portion spaced from the surface thus engaged, said attachment assembly comprising:

(A) a bracket plate adapted to be secured to a surface of the second object and having a keyhole opening therein including a head portion sized to pass the fastener member head portion and a slot portion sized to pass the fastener member shank portion but not the fastener member head portion;

(B) a locking plate, in assembly, maskingly overlying said bracket plate and mounted for movement on said bracket plate between (1) an unlocked position in which said head portion of said keyhole opening is unmasked to allow passage of the fastener member head portion and (2) a locked position in which said slot portion of said keyhole opening is unmasked and said locking plate blocks communication between the slot and head portions of said keyhole opening; and (C) means operative, following passage of the fastener member head portion through said keyhole opening head portion with said locking plate in its unlocked position, to move said locking plate to its locked position in response to movement of the fastener member shank portion into said slot portion, whereby to trap the fastener member shank portion in said slot portion and attach the first object to the second object.

2. An attachment assembly according to claim 1 wherein:

(D) said locking plate includes a release portion; and (E) said attachment assembly further includes a release tool sized and configured to be inserted between the surfaces of the attached objects to engage said release portion of said locking plate and move said plate to its unlocked position to allow the fastener member to be returned to said head portion of said keyhole opening for separation of the objects.

3. An attachment assembly according to claim 1 wherein:

(D) said locking plate, in its unlocked position, presents an actuator edge surface extending across the entrance to said slot portion of said keyhole opening; and (E) said locking plate is mounted for movement from its unlocked to its locked position in response to movement of the fastener member shank portion into said slot portion and into engagement with said actuator edge surface of said locking plate.

4. An attachment assembly according to claim 3 wherein:

(F) said locking plate is mounted for pivotal movement relative to said bracket plate;

(G) the longitudinal center line of said slot portion passes through the pivotal axis of said locking plate;

(H) said actuator edge surface of said locking plate, with said locking plate in its unlocked position, is obliquely disposed with respect to said longitudinal center line of said slot to allow said locking plate to be pivotally displaced to its locking position in response to engagement by the fastener member shank portion as the later moves into said slot;

(I) another blocking edge surface of said locking plate blocks communication between said slot and head portions of said keyhole opening with said locking plate in its locked position; and (J) with said locking plate in its locked position said blocking edge surface is substantially perpendicularily disposed with respect to said longitudinal center line to preclude pivotal movement of said locking plate to its unlocked position in response to engagement by the fastener member shank portion.

5. An attachment assembly according to claim 4 wherein:

(K) said bracket plate includes a plurality of attachment holes adapted to pass fastener elements to secure said bracket plate to the surface of the second object;

(L) said locking plate includes a pivot hole; and (M) in assembly, said locking plate overlies said bracket plate with said pivot hole aligned with one of said attachment holes so that a headed fastener element may be passed through the aligned pivot and fastener holes to define the pivot axis for said locking plate and secure said bracket plate to the surface of the second object.

6. An attachment assembly according to claim 5 wherein:

(N) another of said attachment holes in said bracket plate is positioned so that, in assembly, the periphery of the head of a headed fastener element passing through that other hole engages an edge surface of said locking plate to define the unlocked positon of said locking plate.

7. An attachment assembly according to claim 5 wherein:

(N) said keyhole opening is positioned centrally in said bracket plate with said slot portion extending toward one side edge of said bracket plate;

(O) said bracket plate includes (1) a first attachment hole lying along the side edge thereof opposite said one side edge and on said longitudinal center line, and (2) a second attachment hole lying along said opposite side edge and offset with respect to said longitudinal center line;

(P) said pivot hole in said locking plate is positioned centrally along one side edge of said locking plate; and (Q) in assembly, said pivot hole overlies said first attachment hole and a side edge of said locking plate adjoining said opposite side edge thereof coacts with the periphery of the head of a headed fastener element passing through said second attachment hole to define the unlocked position of said locking plate.

8. An attachment assembly according to claim 1 wherein:

(D) said locking plate is selectively cut out to define an irregular, totally surrounded mask opening therein including:

(1) a first portion configured to unmask said head portion of said keyhole opening in the unlocked position of said locking plate;

(2) a second portion configured to unmask said slot portion of said keyhole opening in the locked positon of said locking plate; and (3) a neck portion at the juncture of said first and second portions having a width sufficient to allow movement of the fastener member shank portion between said first and second portions.

9. An attachment assembly according to claim 8 wherein:

(E) with said locking plate in its unlocked position, an actuator edge surface of said mask opening blocks entry into said keyhole opening slot portion; and (F) said locking plate is mounted for movement from its unlocked to its locked position in response to movement of the fastener member shank portion into said slot portion and into engagement with said actuator edge surface.

10. An attachment assembly according to claim 9 wherein:

(G) with said locking plate in its locked position, another edge surface of said masked opening blocks communication between said slot and head portions of said keyhole opening; and (H) said locking plate is mounted to resist movement from its locked to its unlocked position in response to movement of the fastener member shank portion into engagement with said blocking edge surface.

11. An attachment assembly according to claim 10 wherein:

(I) said locking plate is mounted for pivotal movement on said bracket plate about a pivot axis lying on the longitudinal center line of said slot portion of said keyhole opening;

(J) with said locking plate in its unlocked position, said actuator edge surface of said mask opening is obliquely disposed with respect to said longitudinal center line to allow pivotal movement of said locking plate in response to engagement of said actuator edge surface by the fastener member shank portion; and (K) with said locking plate in its locked position, said blocking edge surface is substantially perpendicularily disposed with respect to said longitudinal center line to preclude pivotal movement of said locking plate in response to engagement of said blocking edge surface by the fastener member shank portion.

12. An attachment assembly according to claim 11 wherein:

(L) said locking plate includes a release portion spaced laterally from said longitudinal center line to allow pivotal movement of said locking plate from its locked to its unlocked position in response to engagement of said release portion by a suitable release tool sized and configured to be inserted between the surfaces of the attached objects.

13. An attachment assembly according to claim 12 wherein:

(M) said assembly includes said release tool;

(N) said release portion is defined by a tab upstanding from the plane of said locking plate at a location adjacent the outer periphery of the locking plate; and (O) said release tool comprises a wire including a hook portion adapted to be hooked over said tab to allow pivotal movement of said locking plate to its unlocked position.

14. An attachment assembly according to claim 12 wherein:

(M) said assembly includes said fastener member.

15. An attachment assembly for lockably securing a frame or the like to a wall surface in cooperation with a fastener member of the type having a shank portion adapted to securingly engage the wall surface and a head portion spaced from the engaged wall surface, said assembly comprising:

(A) a bracket plate adapted to be secured to the back of the frame and having a keyhole opening therein including a head portion sized to pass the fastener member head portion and a slot portion sized to pass the fastener member shank portion but not the fastener member head portion;

(B) a locking plate, in assembly, maskingly overlying said bracket plate and mounted for movement on said bracket plate between:

(1) an unlocked position in which said head portion of said keyhole opening is unmasked to allow passage of the fastener member head portion; and (2) a locked position in which said slot portion of said keyhole opening is unmasked and said locking plate blocks communication between the slot and head portions of said keyhole opening; and (C) means operative, following passage of the fastener member head portion through said keyhole opening head portion with said locking plate in said unlocked position, to move said locking plate to said locked position in response to movement of the fastener member shank portion into said slot portion, whereby to trap the fastener member shank portion in said slot portion and lockably secure the frame to the wall surface.

16. An attachment assembly according to claim 15 wherein said fastener assembly is intended for use with a frame comprising a hollow rectangular frame structure formed by left, right, upper and lower frame members and wherein said assembly includes:

(D) three of said bracket plates, adapted for attachment to the upper left corner, the upper right corner and the central lower frame member of the frame structure respectively; and (E) one of said locking plates, adapted for coaction with the bracket plate centrally secured to the lower frame member.

17. An attachment assembly according to claim 16 wherein:

(F) said bracket plates are rectangular and include a plurality of peripheral mounting holes;

(G) said peripheral holes and said keyhole openings are sized and configured to:

(1) enable the corner bracket plates to be secured to the frame structure with the keyhole openings within the inner periphery of the corner frame structures to allow clearance for passage of the fastener members; and (2) enable the lower bracket plate to be secured to the lower frame member with the keyhole opening above the inner periphery of the lower frame member to allow clearance for passage of a fastener member.

18. An attachment assembly according to claim 17 wherein the frame structure is wooden and said assembly further includes:

(H) a plurality of wood screws adapted to pass through the mounting holes in the bracket plates for threaded engagement with said frame structure.

19. An attachment assembly according to claim 17 wherein the frame structure is metallic and includes a rearwardly opening channel section and wherein said assembly further includes:

(H) a plurality of plastic blocks adapted to be slidably inserted into the channel section of the frame structure at the attachment locations for said bracket plates; and (I) a plurality of self-tapping screws adapted to pass through the mounting holes in the bracket plate for self-tapping engagement with holes in said plastic blocks.

20. An attachment assembly according to claim 16 wherein:

(F) said assembly further includes a plurality of template assemblies; and (G) each said template assembly includes:

(1) a headed, cone point screw adapted to be inserted in the keyhole opening of a respective bracket plate following mounting of that plate to the frame structure and slid upwardly to the top of the slot portion of that opening with the cone point facing rearwardly of the frame structure; and (2) a wing nut adapted to be threaded onto the cone point screw to secure the screw in the slot portion of the keyhole opening for purposes of marking the locations for the fastener members on the wall surface.

21. An attachment assembly for securing a picture frame or the like to a wall surface comprising:

(A) a generally rectangular bracket plate having:

(1) a keyhole opening in the center portion of the plate including a circular head portion and a slot portion extending vertically and centrally upwardly from said head portion and having a width less than the diameter of said head portion, (2) a first mounting hole adjacent the lower edge of the plate spaced below the lowest locus of said circular head portion of said keyhole opening and lying on the vertical center line of said slot portion, and (3) a second mounting hole adjacent the lower edge of the plate spaced laterally from said first mounting hole and spaced below the lowest locus of said head portion, and (B) a generally rectangular locking plate having:

(1) a central mask opening for coaction with said keyhole opening in said bracket plate, and (2) a mounting hole adjacent the lower edge thereof;

(C) a first headed fastener element adapted to pass through said second mounting hole in said bracket plate and into the picture frame to secure said bracket plate to the picture frame, and (D) a second fastener element adapted to pass through said mounting hole in said locking plate and said first mounting hole in said bracket plate and into the picture frame to assist in the securement of said bracket plate to the picture frame and mount the locking plate for pivotal movement on said bracket plate to provide selective masking coaction between said keyhole opening in said bracket plate and said mask opening in said locking plate.

22. An attachment assembly according to claim 21 wherein:

(E) said locking plate is pivotally movable on said bracket plate between a locked position and an unlocked position;

(F) said mask opening in said locking plate is defined in part by an actuator edge surface an in part by a blocking edge surface;

(G) in the unlocked position of said locking plate, said mask opening unmasks said head portion of said keyhole opening and said actuator edge surface extends across the entrance to said slot portion obliquely with respect with said vertical centerline, and (H) in the locked position of said locking plate, said mask opening unmasks said slot portion of said keyhole opening and said blocking edge surface extends across the entrance to said head portion at right angles to said vertical center line.

23. An attachment assembly according to claim 22 wherein there are a plurality of bracket plates as described and each bracket plate additionally includes a mounting hole adjacent its upper edge spaced above the highest locus of said keyhole opening slot portion to enable each of said bracket plates to be secured at any one of a plurality of locations around the picture frame.

* * * * *